US009673010B2

(12) United States Patent
Lee

(10) Patent No.: US 9,673,010 B2
(45) Date of Patent: Jun. 6, 2017

(54) RELAY

(71) Applicant: LSIS CO., LTD., Anyang-si, Gyeonggi-do (KR)

(72) Inventor: Su Jung Lee, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/737,345

(22) Filed: Jun. 11, 2015

(65) Prior Publication Data

US 2015/0380194 A1 Dec. 31, 2015

(30) Foreign Application Priority Data

Jun. 30, 2014 (KR) ..... 20-2014-0004906

(51) Int. Cl.
*H01H 3/00* (2006.01)
*H01H 50/56* (2006.01)
(Continued)

(52) U.S. Cl.
CPC ..... *H01H 50/56* (2013.01); *H01H 50/023* (2013.01); *H01H 50/041* (2013.01);
(Continued)

(58) Field of Classification Search
CPC ..... H01H 9/30; H01H 50/56; H01H 50/20; H01H 50/30; H01H 50/36; H01H 50/041;
(Continued)

(56) References Cited

U.S. PATENT DOCUMENTS 1,226,697 A * 5/1917 Rinsche ..... H01F 7/1607 269/216
1,436,639 A * 11/1922 Bindschedler ..... 335/262
(Continued)

FOREIGN PATENT DOCUMENTS

CN 1211336 3/1999
CN 1969355 5/2007
(Continued)

OTHER PUBLICATIONS

European Patent Office Application Serial No. 15171142.1, Search Report dated Oct. 28, 2015, 7 pages.
(Continued)

*Primary Examiner* — Shawki S Ismail
*Assistant Examiner* — Lisa Homza
(74) *Attorney, Agent, or Firm* — Lee, Hong, Degerman, Kang & Waimey

(57) ABSTRACT

A relay according to one embodiment of the present invention includes a housing, a cylinder, a fixed contactor coupled to the housing, a movable contactor contactable with or separated from the fixed contactor, a coil assembly disposed in the housing to generate a magnetic field, a movable shaft coupled with the movable contactor at an upper portion thereof, a fixed core inserted into the cylinder, a moving core fixed to the movable shaft to move the movable shaft in a pressing manner, a wipe spring to supply elastic force to the movable shaft, and a return spring located between the fixed core and the moving core. The moving core includes a cylindrical protrusion extending toward the fixed core and surrounding the movable shaft.

3 Claims, 5 Drawing Sheets

(51) Int. Cl.

| | |
|---|---|
| ***H01H 50/04*** | (2006.01) |
| ***H01H 50/20*** | (2006.01) |
| ***H01H 50/30*** | (2006.01) |
| ***H01H 50/36*** | (2006.01) |
| ***H01H 50/02*** | (2006.01) |
| ***H01H 51/06*** | (2006.01) |
| *H01H 1/66* | (2006.01) |
| *H01H 9/04* | (2006.01) |

(52) U.S. Cl.
CPC ..... *H01H 50/20* (2013.01); *H01H 50/305* (2013.01); *H01H 50/36* (2013.01); *H01H 51/065* (2013.01); *H01H 1/66* (2013.01); *H01H 9/04* (2013.01); *H01H 2201/00* (2013.01)

(58) Field of Classification Search
CPC ..... H01H 50/305; H01F 7/081; H01F 7/121; H01F 7/13; H01F 7/16; H01F 7/1607; H01F 2007/086
USPC ..... 335/192
See application file for complete search history.

(56) References Cited

U.S. PATENT DOCUMENTS 2,407,603 A * 9/1946 Derungs ..... H01F 7/13 335/177
2,407,963 A * 9/1946 Persons ..... H01F 7/13 335/260
2,951,133 A * 8/1960 Davies ..... H01H 9/04 174/50.58
3,168,242 A * 2/1965 Diener ..... G05D 23/24 236/75
3,381,250 A * 4/1968 Weathers ..... H01F 7/13 335/255
3,505,628 A * 4/1970 Allen ..... H01F 7/1607 335/255
3,735,302 A * 5/1973 Eckert ..... H01F 7/1607 335/262
3,805,204 A * 4/1974 Petersen ..... H01F 7/1607 335/255
3,806,850 A * 4/1974 McFarlin ..... H01H 50/20 335/203
3,983,520 A * 9/1976 Sakata ..... H01H 50/32 335/170
4,008,448 A * 2/1977 Muggli ..... H01F 7/08 335/258
4,016,965 A * 4/1977 Wirth ..... B41J 2/285 335/258
4,419,643 A * 12/1983 Ojima ..... H01F 7/1615 335/230
4,494,096 A * 1/1985 Fuzzell ..... H01F 7/124 335/170
4,604,600 A * 8/1986 Clark ..... H01F 7/13 335/261
4,638,279 A * 1/1987 Brisson ..... H01H 50/305 335/193
4,654,617 A * 3/1987 Grenier ..... H01H 50/32 335/191
4,700,165 A * 10/1987 Brisson ..... H01F 7/1205 335/245
RE32,793 E * 11/1988 Baker ..... H01F 7/124 200/231
4,855,702 A * 8/1989 Swanson ..... H01F 7/1607 335/261
5,066,980 A * 11/1991 Schweizer ..... H01F 7/13 335/255
5,123,718 A * 6/1992 Tyler ..... B60T 8/00 303/118.1
5,234,265 A * 8/1993 Tyler ..... B60T 8/00 303/118.1
5,918,635 A * 7/1999 Wang ..... F16K 31/0693 137/625.65
5,959,519 A * 9/1999 Gobel ..... H01F 7/1615 335/132
6,051,897 A * 4/2000 Wissler ..... H02K 11/21 310/12.19
6,229,421 B1 * 5/2001 Floyd ..... H01F 7/124 335/229
6,244,298 B1 * 6/2001 Sugita ..... F16K 11/0743 137/625.43
6,498,416 B1 * 12/2002 Oishi ..... F02M 51/0614 310/214
7,280,019 B2 * 10/2007 Kolb ..... H01F 7/1615 335/229
7,874,541 B2 * 1/2011 Abe ..... F16K 31/0613 137/625.69
8,228,149 B2 * 7/2012 Puth ..... H01F 7/1615 335/220
8,581,682 B2 * 11/2013 Patino ..... H01H 51/2209 335/220
8,973,894 B2 * 3/2015 Ozaki ..... F16K 31/0655 251/129.15
9,163,694 B2 * 10/2015 Goldasz ..... F16F 9/464
9,368,266 B2 * 6/2016 Maller ..... H01F 7/1607
2008/0290972 A1 * 11/2008 Jotter ..... B29C 45/281 335/229
2009/0066450 A1 * 3/2009 Yano ..... H01H 49/00 335/203
2009/0284335 A1 11/2009 Kim et al.
2010/0225427 A1 * 9/2010 Fujimoto ..... H01H 50/043 335/2
2011/0032059 A1 * 2/2011 Ito ..... H01H 9/34 335/202
2013/0240495 A1 * 9/2013 Yano ..... H01H 9/36 219/123
2015/0123753 A1 * 5/2015 Kawaguchi ..... H01H 50/20 335/203
2015/0213981 A1 * 7/2015 Choi ..... H01H 50/32 335/185
2015/0380194 A1 * 12/2015 Lee ..... H01H 50/041 335/192
2016/0079022 A1 * 3/2016 An ..... H01H 9/30 335/187

FOREIGN PATENT DOCUMENTS

| | | |
|---|---|---|
| CN | 101582351 | 11/2009 |
| CN | 102543582 | 7/2012 |
| EP | 1768152 | 3/2007 |
| EP | 2442333 | 4/2012 |
| JP | 2-35863 | 12/1991 |
| JP | 3126339 | 12/1991 |
| JP | 11-232986 | 8/1999 |
| JP | 2003513412 | 4/2003 |
| JP | 2006019148 | 1/2006 |

OTHER PUBLICATIONS

Japan Patent Office Application Serial No. 2015-117940, Office Action dated Jun. 28, 2016, 2 pages.
State Intellectual Property Office of the People's Republic of China Application Serial No. 201510363448.4, Office Action dated Dec. 23, 2016, 6 pages.

* cited by examiner

RELAY

CROSS-REFERENCE TO RELATED APPLICATION

Pursuant to 35 U.S.C. §119(a), this application claims the benefit of earlier filing date and right of priority to Korean utility model No. 20-2014-0004906, filed on Jun. 30, 2014, the contents of which is incorporated by reference herein in its entirety.

BACKGROUND OF THE DISCLOSURE

1. Field of the Disclosure

This specification relates to a relay.

2. Background of the Disclosure

A relay is a switching element configured in such a manner that a moving core is brought into contact with a fixed core in response to magnetic force of a coil, which is generated when power is supplied to the coil, and simultaneously a shaft moves up to make a movable contactor come in contact with a fixed contactor such that current can flow.

A current flows along the relay when the fixed contactor and the movable contactor come in contact with each other. Specifically, the relay uses a permanent magnet for controlling arc which is generated upon blocking high voltage direct current (DC) power. That is, the relay uses an arc-extinguishing mechanism that the permanent magnet is appropriately disposed adjacent to the fixed contactor and the movable contactor generating the arc, and the arc is controlled, cooled and extinguished using a force decided according to strength, and direction of magnetic flux generated in the permanent magnet, a current direction, and an elongated length of the arc.

A contact surface of a moving core with a fixed core is designed into various shapes, such as a corn-like shape (FIG. 3) and a planar shape (FIG. 1), according to a product characteristic. The moving core of the planar shape illustrated in FIG. 1 is configured such that the moving core and the fixed core come in contact with each other in a flat shape. On the other hand, for the corn-like moving core illustrated in FIG. 3, for example, a triangular moving core comes in contact with a fixed core which has a shape of accommodating the moving core therein.

FIG. 1 illustrates a relay 100*a* having a moving core of a planar shape according to the related art. As illustrated in FIG. 1, the relay 100*a* includes a moving unit 140 that has a contact and is movable, a gas sealing unit that seals a space filled with arc-extinguishing gas, and a magnetic driving unit that supplies a driving force for operating the moving unit 140. Here, the moving unit 140 includes a shaft 141, a cylindrical moving core 145*a* that is connected to a lower portion of the shaft 141 to be linearly movable along with the shaft 141 and also movable by a magnetic attractive force from the magnetic driving unit, and a movable contactor 149 that is connected to an upper end portion of the shaft 141 to form an electric contact portion. A fixed core 143*a* surrounding the shaft 141 is disposed at a position facing the moving core 145*a*. The fixed core 143*a*, the moving core 145*a*, a second barrier 118 and the like form a moving circuit of a magnetic flux.

The gas sealing unit is located around an upper portion of the moving unit 140 so as to form an arc-extinguishing gas chamber, in which arc-extinguishing gas of the relay is hermetically stored. The gas sealing unit includes a tubular sealing member, a pair of fixed contactors 120 extending through the insulating member and airtightly coupled to the insulating member, a tubular airtight member formed in a stepped shape to airtightly seal a gap between the insulating member and the second barrier 118, and a cylinder 160 hermetically surrounding the moving core 145 and the fixed core 143 and formed of a non-magnetic material. Here, the pair of fixed contactors 120 is electrically connected with a DC power source side and a load side, respectively, via electric wires, for example.

The magnetic driving unit that opens or closes the relay by driving the moving core 145 and the movable contact 149 to be explained later using a magnetic attractive force generated therein includes an excitation coil 133 and the second barrier 118. Here, the excitation coil 133 is a driving coil provided in a lower portion of the relay. The excitation coil 133 is magnetized when a current is supplied thereto, and demagnetized when the applied current is cut off. In the relay, the magnetic driving unit generates the magnetic attractive force to supply a driving force to the moving unit for opening or closing contacts. The second barrier 118 is provided above the excitation coil 133. When the excitation coil 133 is magnetized, the second barrier 118 constructs a part of a moving path of a magnetic flux together with the moving core 145 and the fixed core 143. A lower yoke forms the moving path of the magnetic flux together with the second barrier 118, the moving core 145 and the fixed core 143 when the excitation coil 133 is magnetized.

A bobbin 131 supports the excitation coil 133 which is wound therearound. A return spring 183 supplies elastic force to the moving core 145 to return to its original position, namely, a position spaced apart from the fixed core 143 when the excitation coil 133 is demagnetized. The return spring 183 is located between the moving core 145 and the fixed core 143.

FIG. 2 illustrates the moving core 145 according to the related art, which illustrates a structure of the moving core 145 which has a step therein for the return spring 183 to be mounted thereon. However, such structure has problems, such as assembly property, durability and the like, as described hereinafter.

FIG. 3 illustrates a relay having a corn-shaped moving core 145*b*, which will help explaining the present invention.

Hereinafter, an operation of the related art relay having such configuration will be briefly described. When the excitation coil 133 is magnetized by receiving current, a magnetic flux generated from the excitation coil 133 moves along a moving path, which is formed by a moving core 145*a*, a fixed core 143*a*, a second barrier 118 and a lower yoke (not illustrated), so as to form a closed circuit. During this, the moving core 145*a* linearly moves to be brought into contact with the fixed core 143*a* and simultaneously a shaft 141 which is connected with the moving core 145*a* also moves upward along with the moving core 145*a*. A movable contactor 149 located on the upper end portion of the shaft 141 is then brought into contact with the fixed contactor 120. Accordingly, a DC power source side and a load side are connected, such that DC power can be supplied (i.e., On state). On the other hand, when a current supplied to the excitation coil 133 is cut off, the moving core 145*a* returns to its original position, at which it is spaced apart from the fixed core 143*a*, by the return spring 183. Responsive to this, the shaft 141 which is connected to the moving core 145*a* also moves downward. Accordingly, the movable contactor 149 provided on the upper end portion of the shaft 141 is separated from the fixed contactor 120 and thus the DC power source side and the load side are disconnected, such that the supply of the DC power is stopped (i.e., Off state).

When power is applied through a coil terminal, magnetic force is generated on a coil assembly, and accordingly the moving core moves upward while pushing up the shaft in a direction toward the fixed core. Here, a short-circuit performance of the relay is decided based on compressive force of two types of springs when the relay is switched on. In general, since a weight of a wipe spring 181 is considerably greater than that of the return spring 183, the short-circuit performance of the relay depends on maximum compressive force of the wipe spring. Compressive force of a spring is in proportion to maximum compressive distance, and decided based on a distance between the fixed core and the moving core and a distance between the fixed contactor and the movable contactor.

The coupling between the moving core of the planar shape and the fixed core requires for strong magnetic force between the fixed core and the moving core. The strong magnetic force allows the moving core to move the shaft, thereby short-circuiting between the fixed contactor and the movable contactor. Specifically, while the fixed core and the moving core are spaced apart from each other, the strong magnetic force is required at the beginning, which is the moment when a current is applied to a coil.

The spring is interfered by the moving core, the fixed core or the shaft, and thereby is likely to generate a deviation during its operation. Also, the spring has upper and lower surfaces both with the same flat shape, which may cause a wrong assembly when assembling the moving core.

SUMMARY OF THE DISCLOSURE

Therefore, an aspect of the detailed description is to improve an operation characteristic of a relay by providing strong initial magnetic force between a moving core and a fixed core in a manner of additionally providing a protrusion on the moving core of the relay.

Another aspect of the detailed description is to provide a relay capable of improving an assembly performance by minimizing interference between a return spring and relevant components.

To achieve these and other advantages and in accordance with the purpose of this specification, as embodied and broadly described herein, there is provided a relay including a housing, a cylinder coupled to an inner side of the housing, a fixed contactor coupled to the housing, a movable contactor movably located within the housing and contactable with or separated from the fixed contactor, a coil assembly disposed in the housing and configured to generate a magnetic field when a current is applied, a movable shaft coupled with the movable contactor at an upper portion thereof, a fixed core inserted into the cylinder and surrounding the movable shaft, a moving core fixed to the movable shaft and configured to move the movable shaft in a pressing manner by the magnetic field generated in the coil assembly, a wipe spring configured to supply elastic force to the movable shaft such that the movable contactor moves to be brought into contact with the fixed contactor, and a return spring surrounding the movable shaft and located between the fixed core and the moving core. Here, the moving core may include a cylindrical protrusion extending toward the fixed core and surrounding the movable shaft to improve initial magnetic force between the fixed core and the moving core.

In another exemplary embodiment of the present invention, the protrusion may be provided with a chamfer formed on an end thereof.

The fixed core may include an accommodating portion configured to accommodate therein the return spring or the protrusion.

An upper end of the return spring may come in contact with an end of the accommodating portion, and a lower end of the return spring may come in contact with the protrusion, such that the return spring is elastically deformed between the end of the accommodating portion and the protrusion.

An outer diameter of the protrusion may be smaller than or equal to an inner diameter of the accommodating portion.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of a relay according to the present invention, with reference to the accompanying drawings. Explaining the features of the present invention, similar/like portions to those of the related art will briefly be described within a necessary range.

Figure 1:
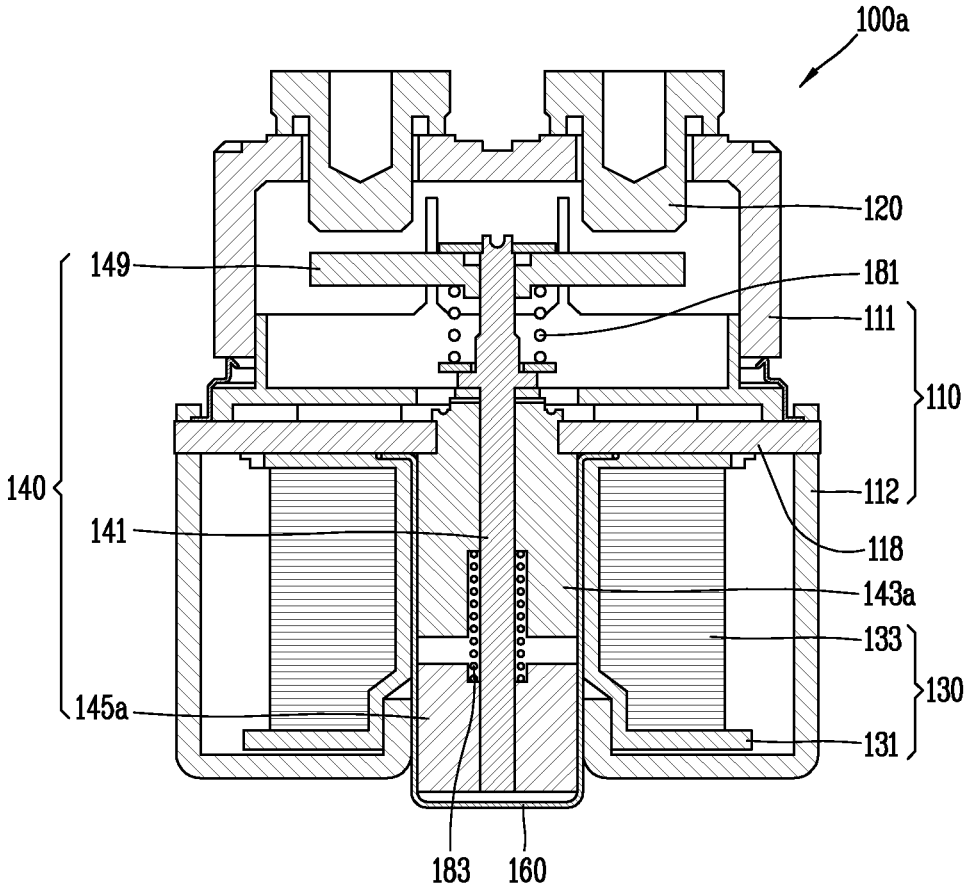
FIG. 1 RELATED ART
FIG. 1 is a sectional view of a relay having a moving core of a planar shape according to the related art.
Figure 2:
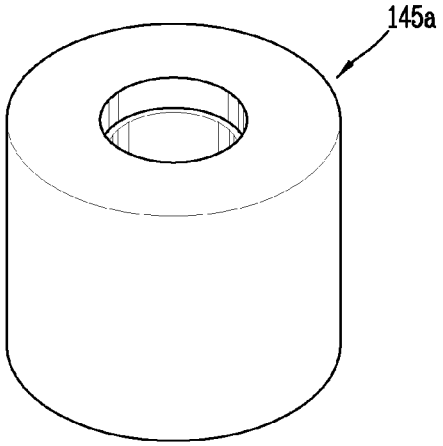
FIG. 2 RELATED ART
FIG. 2 is a perspective view of the moving core of FIG. 1.
Figure 3:
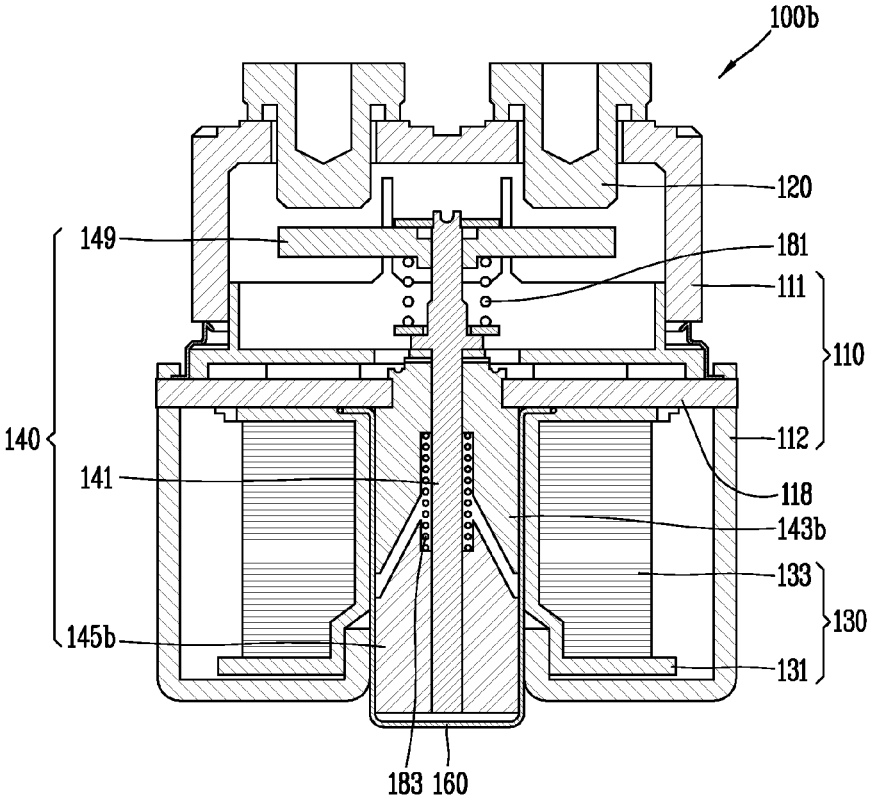
FIG. 3 RELATED ART
FIG. 3 is a sectional view of a relay having a corn-shaped moving core according to the related art.
Figure 4:
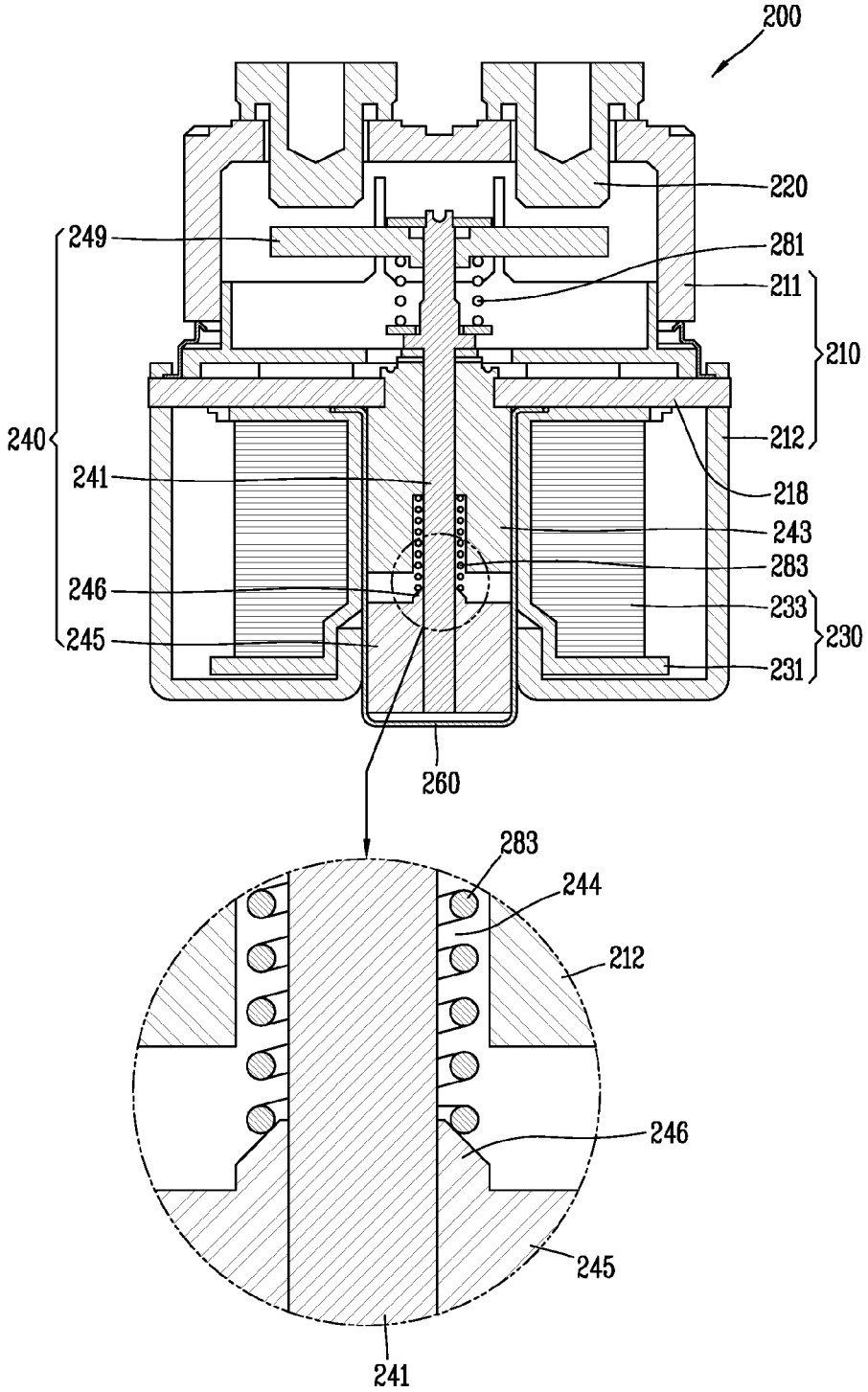
FIG. 4 is a sectional view illustrating a state that a protrusion of a moving core is accommodated in a fixed core in a relay in accordance with one exemplary embodiment of the present invention.

FIG. 4 illustrates a relay 200 in accordance with one exemplary embodiment of the present invention. As illustrated in FIG. 4, a movable shaft 241 is movably located within a housing 210. A movable contactor 249 and moving core 245 are coupled to upper and lower portions of the movable shaft 241, respectively. The moving core 245 is coupled to the movable shaft 241 so as to move along with the shaft 241. When the moving core 245 is moved by magnetic force generated from a coil assembly 230, the movable shaft 241 and the movable contactor 249 move together, such that the movable contactor 249 can be brought into contact with a fixed contactor 220.

The moving core 245 is located within a cylinder 260. The magnetic force which is generated when a current is applied to the coil assembly is transferred to the moving core 245. The moving core 245 which has received the magnetic force allows the movable shaft 241 to be moved in a pressing manner.

The moving core 245 includes a protrusion 246. The protrusion 246 is a cylindrical member protruding toward the fixed core 243, and surrounds the movable shaft 241.

Figure 6:
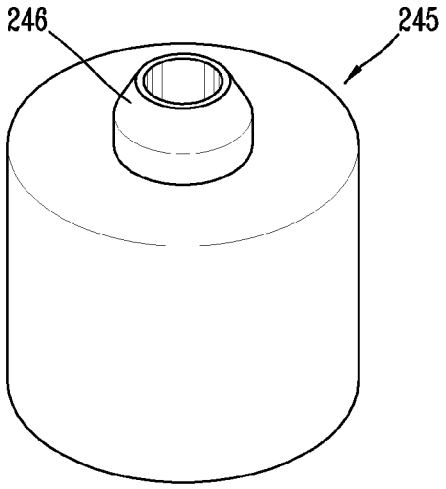
FIG. 6 is a perspective view of a moving core illustrated in FIG. 4.

As illustrated in FIG. 6, the protrusion 246 may be provided with a chamfer processed on one end thereof. The chamfer of the protrusion 246 may derive an improvement of an assembly property and a reduction of interference between the moving core 245 and a return spring 283. The chamfer of the protrusion 246 receives elastic force of the return spring 283. The chamber of the protrusion 246 may be formed at an angle of about 45° or formed within a range of facilitating an elastic deformation of the return spring 283. However, the present invention may not be limited to this, but be practiced in another embodiment illustrating a structure of a moving core having a cylindrical protrusion without a chamfer.

The moving core 245 may be movable within the cylinder 260 by the magnetic force while coming in contact with an inner circumferential surface of the cylinder 260, or fixedly welded onto an outer side of the movable shaft 241. The protrusion 246 of the moving core 245 is formed integrally with the moving core 245.

The fixed core 243 has a cylindrical shape and is fixed into the cylinder 260. The fixed core 243 is provided with a hole formed therethrough in a lengthwise direction thereof, so as to guide the movement of the movable shaft 241, which will be explained later.

The fixed core 243 includes an accommodating portion 244. The accommodating portion 244 is a space in which the return spring 283 is located and the protrusion 246 is accommodated. The accommodating portion 244 may have an inner diameter which is wider than an outer diameter of the protrusion 246, or equal to the outer diameter of the protrusion 246 such that an inner circumferential surface of the accommodating portion 244 can come in contact with an outer circumferential surface of the protrusion 246.

With the formation of the protrusion, when a current is applied to an excitation coil 233, the moving core 245 can be more closely adhered onto the fixed core 243. This may allow for generating stronger initial magnetic force between the fixed core 243 and the moving core 245, thereby improving an operation performance of the relay. The initial magnetic force, as aforementioned, refers to the magnetic force generated at the moment when a current is applied to a coil while the fixed core and the moving core are spaced apart from each other.

A wipe spring 281 is located at an upper side of the movable shaft 241 in a contact state with the movable contactor 249. A return spring 283 may be located between the moving core 245 and the fixed core 243 or between the movable contactor 249 and the movable shaft 241.

The wipe spring 281 may apply elastic force to the movable shaft 241 such that the movable contactor 249 can be brought into contact with the fixed contactor 220, and maintain contact pressure between contacts when the movable contactor 249 is in the contact state with the fixed contactor 220. The wipe spring 281 is elastically deformed by being pressed between the movable contactor 249 and the movable shaft 241.

The return spring 283 applies elastic force to the moving core 245 such that the movable contactor 249 can be separated from the fixed contactor 220. The return spring 283 is elastically deformed by being pressed between the moving core 245 and the fixed core 243.

The relay includes the housing 210. The housing 210 may further include a first housing 211 and a second housing 212.

The first housing 211 may be located at an upper outer portion of the relay and coupled to a first barrier (not illustrated) which comes in contact with a part of a second barrier 218 to be explained later. The first housing 211 is divided into an arc-extinguishing area, in which the fixed contactor 220 and the movable contactor 249 come in contact with each other, and the other area. The first housing 211 may be made of a ceramic material for insulation. A pair of fixed contactors 220 is airtightly coupled to the first housing 211 through an upper surface of the first housing 211.

The second housing 212 may be located at a lower outer side of the relay and coupled to the second barrier 218. The cylinder 260 is coupled to an actuator area defined by the second housing 212 and the second barrier 218, and a coil assembly 230 surrounds the cylinder 260.

Hereinafter, description will be given in more detail of an operation of an embodiment of a relay according to the present invention with reference to FIGS. 4 and 5.

First, as illustrated in FIG. 4, while a current is not applied to the coil assembly 230, elastic force of the return spring 283 is merely applied to the moving core 245. Hence, the movable shaft 241 is maintained in a downwardly-moved state, and accordingly the movable contactor 250 is spaced apart from the fixed contactor 220.

Meanwhile, when a current is applied to the coil assembly 230 to magnetize the coil 233, magnetic flux generated in the coil 233 moves along the moving core 245, the fixed core 243, the second barrier 218 and the like, thereby forming a closed circuit. Accordingly, the moving core 245 is subject to magnetic force applied in an upward direction.

The moving core 245 receives strong initial magnetic force at the moment of moving up, by virtue of the protrusion 246. Therefore, with high operation characteristic, the moving core can move along with the movable shaft 241 by receiving sufficient magnetic force.

Figure 5:
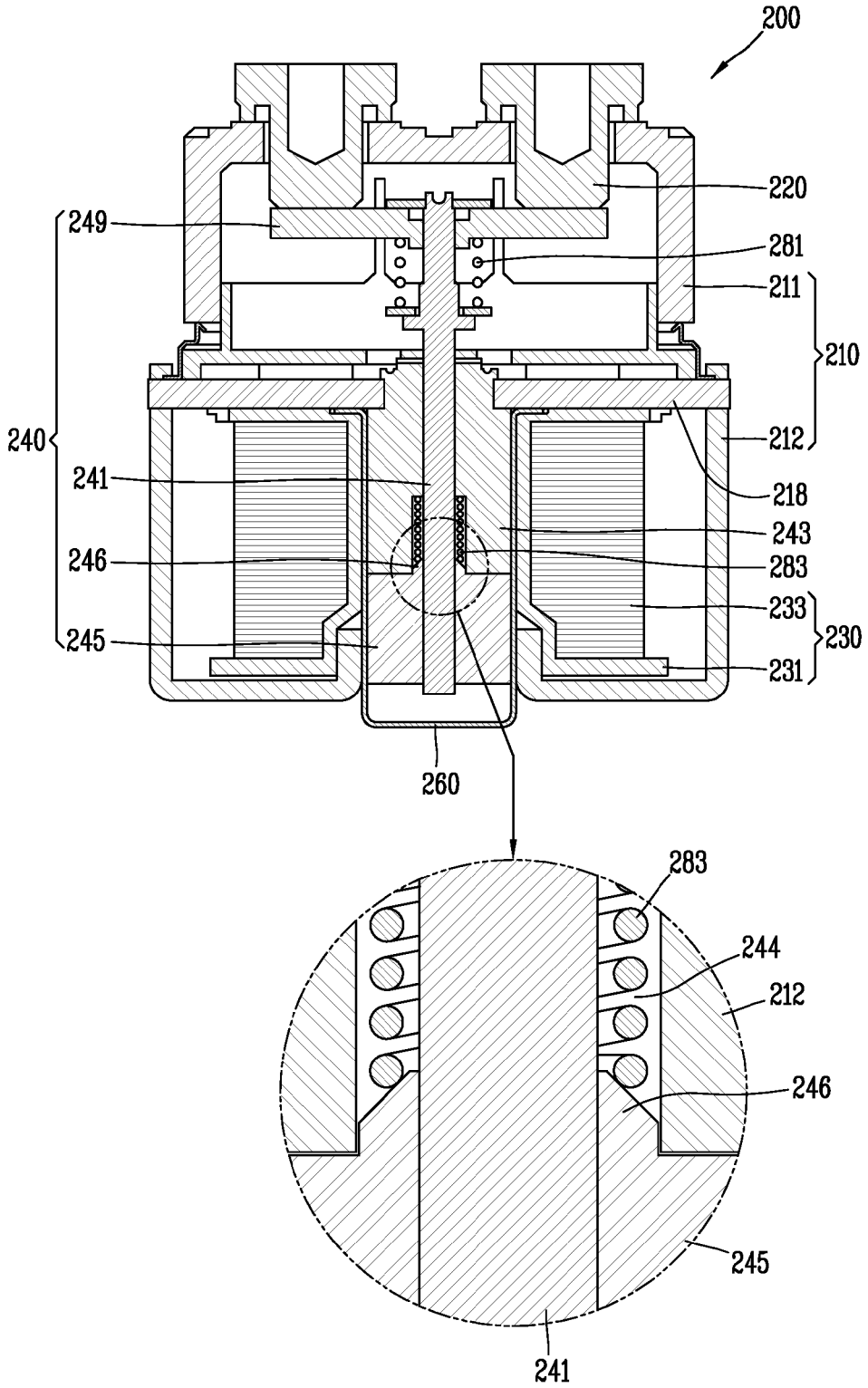
FIG. 5 is a sectional view illustrating a state that the protrusion of the moving core is separated from the fixed core in the relay in accordance with the one exemplary embodiment of the present invention.

As illustrated in FIG. 5, the moving core 245 moves toward the fixed core 243 such that the protrusion 246 is accommodated in the fixed core 243. The movable contactor 249 accordingly comes in contact with the fixed contactor 220 and the wipe spring 281 is pressed.

When the current supplied to the coil assembly 230 is cut off, the moving core 245 is moved downward along with the movable shaft 241 by the return spring 283, and accordingly the movable contactor 249 and the fixed contactor 220 are separated from each other.

Figure 7:
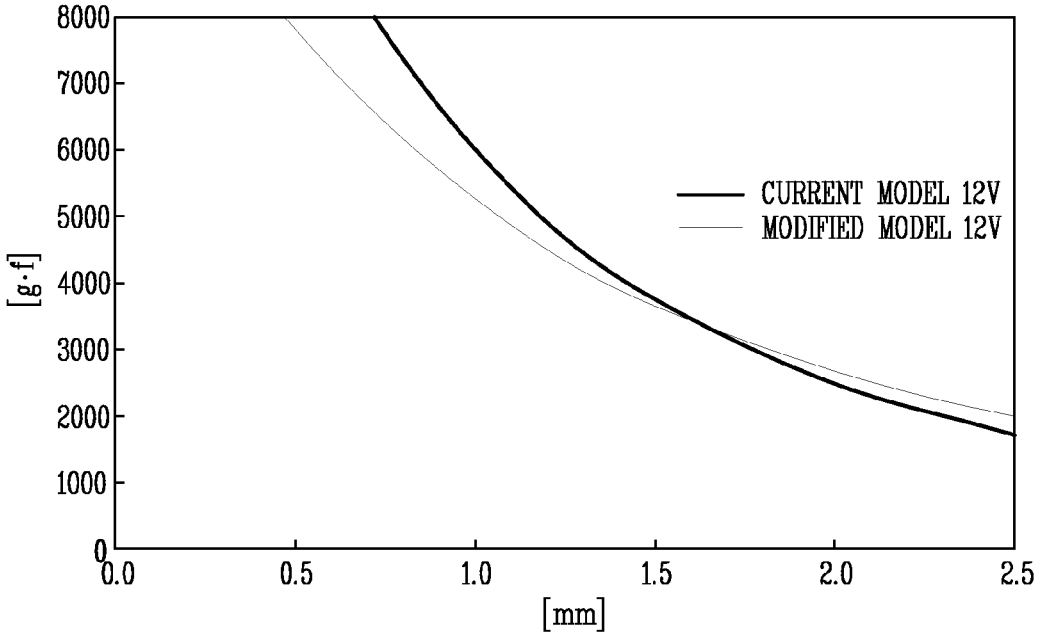
FIG. 7 is a graph showing intensity of magnetic force according to a distance between a moving core and a fixed core.

A graph of FIG. 7 shows initial magnetic force which is improved by the protrusion as one embodiment of the present invention. An x-axis indicates a distance between the moving core and the fixed core, and y-axis indicates strength of the magnetic force. As aforementioned, intensity of initial magnetic force at the moment of applying a current to the coil assembly has an important influence on the operation performance of the relay. Referring to the right side of the graph, the intensity of the magnetic force is about 2200 [g·f] when there is the protrusion at a distance of 2.5 [mm] and about 1800 [g~f] when there is no protrusion. It can thusly be noticed that there is not a great difference of the initial magnetic force.

The foregoing detailed description is a detailed example as the embodiment of the present invention to be practiced by those skilled in the art, and not construed to limit the applicant's right. The applicant's right is defined by the utility registration claims to be described below.

According to one embodiment of the present invention, a moving core of a relay is further provided with a protrusion. In an initial state that the moving core and a fixed core are spaced apart from each other, the protrusion can reduce a distance between the moving core and the fixed core. Accordingly, when a current is applied to a coil, strong initial magnetic force can be obtained. Consequently, an initial operation characteristic of the relay can be improved by virtue of the protrusion of the moving core.

Also, with the structure of fixing a return spring using the protrusion, interference between the return spring and other relevant components, such as the moving core, the fixed core and a shaft, can be reduced, thereby improving assembly property.

With the formation of the protrusion of the moving core, unnecessary abrasion between the return spring and the relevant components can be reduced, resulting in improvement of durability of the return spring and the like.

What is claimed is:

1. A relay comprising:

a housing;

a cylinder coupled to an inner side of the housing;

a fixed contactor coupled to the housing;

a movable contactor located within the housing and configured to contact or separate from the fixed contactor;

a coil assembly located in the housing and configured to generate a magnetic field when a current is applied;

a movable shaft coupled with an upper portion of the movable contactor;

a fixed core inserted into the cylinder and surrounding the movable shaft;

a movable core fixed to the movable shaft and configured to move the movable shaft in response to the generated magnetic field;

a wipe spring configured to supply elastic force to the movable shaft such that the movable contactor contacts the fixed contactor; and a return spring located between the fixed core and the movable core and surrounding the movable shaft, wherein the movable core comprises a cylindrical protrusion extending toward the fixed core and surrounding the movable shaft such that initial magnetic force between the fixed core and the movable core is increased, wherein the fixed core comprises a cylindrical accommodating portion configured to accommodate the cylindrical protrusion, wherein an inner circumferential surface of the cylindrical protrusion contacts the movable shaft and an outer circumferential surface of the cylindrical protrusion contacts an inner circumferential surface of the fixed core, wherein an end of the cylindrical protrusion comprises a chamfer, wherein the cylindrical accommodating portion is further configured to accommodate the return spring, wherein an upper end of the return spring contacts an end of the cylindrical accommodating portion, and wherein a lower end of the return spring contacts the chamfer such that the return spring does not enter the movable core and is elastically deformed between the end of the cylindrical accommodating portion and the cylindrical protrusion.

2. The relay of claim 1, wherein an outer diameter of the cylindrical protrusion is smaller than or equal to an inner diameter of the cylindrical accommodating portion.

3. The relay of claim 1, wherein the chamfer is formed at an angle of approximately 45°.

* * * * *